US006651256B1

(12) United States Patent
Swift

(10) Patent No.: US 6,651,256 B1
(45) Date of Patent: Nov. 25, 2003

(54) WEARABLE PILLOW

(76) Inventor: Carol L. Swift, 116 Coquina Dr., Wilmington, NC (US) 28411-9327

( * ) Notice: Subject to any disclaimer, the term of this patent is extended or adjusted under 35 U.S.C. 154(b) by 0 days.

(21) Appl. No.: 10/210,899

(22) Filed: Aug. 5, 2002

(51) Int. Cl.[7] ..... A42B 1/00; A42B 1/08

(52) U.S. Cl. ..... 2/171; 2/15; 2/202; 2/203; 2/412; 2/423

(58) Field of Search ..... 2/15, 171, 411, 2/412, 202, 205, 203, 423; 5/636; 128/202.18

(56) References Cited

U.S. PATENT DOCUMENTS

| | | | | | |
|---|---|---|---|---|---|
| 945,839 | A | * | 1/1910 | Brisbane | 2/15 |
| 1,284,240 | A | * | 11/1918 | Close | 2/6.1 |
| 2,367,459 | A | * | 1/1945 | Corley | 2/209 |
| 2,533,526 | A | * | 12/1950 | Snyder | 2/423 |
| 2,696,007 | A | * | 12/1954 | Larkin et al. | 2/171 |
| 3,171,133 | A | | 3/1965 | Steffen | |
| 3,538,508 | A | * | 11/1970 | Young | 2/205 |
| 3,688,314 | A | | 9/1972 | Hill | |
| 3,725,956 | A | * | 4/1973 | Reisen | 2/171 |
| 3,780,379 | A | * | 12/1973 | Kampman | 2/15 |
| 4,062,067 | A | | 12/1977 | Franzen | |
| 4,330,892 | A | | 5/1982 | Fukushima | |
| 4,605,000 | A | | 8/1986 | Anguita | |
| 4,679,263 | A | * | 7/1987 | Honer | 5/636 |
| 4,738,488 | A | | 4/1988 | Camelio | |
| 4,759,082 | A | * | 7/1988 | Mulligan | 2/69.5 |
| 4,779,930 | A | | 10/1988 | Rosen | |
| 4,783,866 | A | | 11/1988 | Simmons et al. | |
| 4,823,407 | A | * | 4/1989 | Phillips et al. | 2/202 |
| 4,887,319 | A | | 12/1989 | Daniels | |
| 4,947,488 | A | | 8/1990 | Ashinoff | |
| 4,951,337 | A | * | 8/1990 | Hull et al. | 5/636 |
| 5,062,163 | A | | 11/1991 | Avey | |
| 5,086,520 | A | | 2/1992 | Arai | |
| 5,205,611 | A | | 4/1993 | Stephens | |
| D343,927 | S | | 2/1994 | Hamdan | |
| 5,330,255 | A | | 7/1994 | Stawicki | |
| 5,375,278 | A | | 12/1994 | VanWinkle et al. | |
| 5,606,744 | A | | 3/1997 | Lindy | |
| 5,881,390 | A | | 3/1999 | Young | |
| 6,088,836 | A | * | 7/2000 | de Cordova | 2/171 |
| 6,370,698 | B1 | * | 4/2002 | Ahl | 2/205 |

FOREIGN PATENT DOCUMENTS

| | | | | |
|---|---|---|---|---|
| JP | 2001149402 A | * | 6/2001 | A61F/7/10 |
| WO | WO 9908628 A1 | * | 2/1999 | A61F/5/00 |

* cited by examiner

*Primary Examiner*—Rodney M. Lindsey
(74) *Attorney, Agent, or Firm*—Donald R. Schoonover

(57) ABSTRACT

A pillow is worn in the manner of a helmet and includes an inner layer of cotton type material, an outer layer and an intermediate layer of foam or the like. The pillow blocks noise from getting to the wearer and can block light as well. The pillow also includes a neck-supporting portion. A stretchable neck-encircling portion permits the pillow to be pulled over the wearer's head while holding the pillow snugly in place.

7 Claims, 1 Drawing Sheet

WEARABLE PILLOW

BACKGROUND OF THE INVENTION

1. Field of the Invention

The present invention relates to the general art of bedding, and to the particular field of pillows.

2. Discussion of the Related Art

A full and restful sleep period has been proven to be necessary for people to have a productive wake period. This has been proven again and again in clinical tests for both adults and children. This is especially necessary for students and anyone who is required to execute exacting work. However, due to an ever-increasing work load, many people do not have a luxury of completing the necessary sleep period in an uninterrupted manner. These people often simply miss out on the required sleep. Over time, this can be harmful both of the person's health and of their productivity.

Many people have to complete their sleep period in an environment that may include sleep-distracting events. These events include noise, light and the like. Therefore, a sleep period can be interrupted which may exacerbate the already problematic situation of a shortened sleep period. This is especially troublesome for people who must sleep during the day when noise and light are likely to occur.

Most people use a pillow during sleep. However, prior known pillows generally have no provision for assisting a person's sleep by insulating that person from sleep-distracting events such as noise and light.

Therefore, there is a need for a pillow that can be used to insulate the hearing of a user from distractions that can interfere with sleep.

Many pillows are simply elements that support a user's head during use. While this is acceptable for many situations, to take full advantage of a sleep period, all items should be designed for the most efficient contribution to the user's sleep period. This requires support of the fullest possible amount of the user's body during the sleep period.

Therefore, there is a need for a pillow that can be used to support a user's head and neck during use.

Still further, a user often tosses and turns during sleep. This may cause the user to move his or her head from the pillow, which is not desirable. Or it may require the user to get used to keeping their head on a pillow which may, on some level, distract the user's sleep. Still further, some sleep periods do not permit use of a standard pillow due to size and or space constraints. A common example of this is the sleeper trying to sleep while on an airplane or in an automobile. Such sleepers generally try to rest their heads on their arms or the like. This can be uncomfortable and is not as efficient as possible.

Therefore, there is a need for a pillow that is comfortable and can be worn by a user.

Many young children require naps. Often it is difficult to persuade such children to go to sleep. Therefore, anything that can be conducive to persuading a young child to sleep will be helpful.

Therefore, there is a need for a pillow that can be enticing to small children.

PRINCIPAL OBJECTS OF THE INVENTION

It is a main object of the present invention to provide a pillow that can be used to insulate the hearing of a user from distractions that can interfere with sleep.

It is another object of the present invention to provide a pillow that is comfortable and can be worn by a user.

It is another object of the present invention to provide a pillow that can be used to support a user's head and neck during use.

It is another object of the present invention to provide a pillow that can be enticing to small children.

It is another object of the present invention to provide a pillow that can be used to insulate the hearing and sight of a user from distractions that can interfere with sleep.

SUMMARY OF THE INVENTION

These, and other, objects are achieved by a pillow that can be worn in the manner of a helmet and which comprises a head-encircling portion having an outer layer and an inner layer, with the inner layer including a cotton-like material and which includes a portion thereof that covers the wearer's ears in a manner that reduces the amount of noise reaching the user's ears. The pillow further includes a neck-encircling section which completely encircles a user's neck when the head-encircling portion is worn by the user, a face-exposing section defined in the head-encircling portion, an eye-covering portion which is hingeably attached to the head-encircling portion adjacent to the face-exposing portion and which is movable between a first position covering the user's eyes and a second position uncovering the user's eyes when the head-encircling portion is worn by the user. A neck-supporting portion is releasably attached to the head-encircling portion when the neck-supporting portion is worn. The neck-supporting portion includes a fastener which engages a fastener on the head-encircling portion when the neck-supporting portion is worn. The neck-supporting portion also includes an outer layer, an inner layer of cotton material, and two spaced apart ends.

The pillow is worn in the manner of a helmet, but acts as a pillow by supporting the user's head and neck. The pillow embodying the present invention also reduces the amount of noise that reaches the wearer as well as the amount of light that reaches the wearer. In this manner, the pillow embodying the present invention not only acts as a pillow, it also acts to reduce the sensory noises and lights that may interfere with the user's normal sleep. The user can wear this pillow any time and any where so the user can obtain a restful sleep at any time. There is no need for the user to contort himself or herself in order to block out noise or light and thus a pleasant and restful sleep can be obtained.

It is also noted that while the pillow of the present invention can be used for enhancing a person's sleep, it can also be used if a person simply wants some quiet time, such as for meditation or the like. It can also be used to make a person who has undergone some treatment, such as by a chiropractor or the like, more comfortable. These, and other uses of the pillow embodying the present invention as will be understood by those skilled in the art based on the teaching of the present disclosure are also contemplated as falling within the scope of this disclosure.

One form of the pillow embodying the present invention includes decorative elements that might appeal to a child. This will encourage children, especially young children, to go to sleep. This will assist an adult in persuading a child to take their nap or to go to bed on time.

BRIEF DESCRIPTION OF THE DRAWING FIGURES

DETAILED DESCRIPTION OF THE INVENTION

Other objects, features and advantages of the invention will become apparent from a consideration of the following detailed description and the accompanying drawings.

Figure 1:
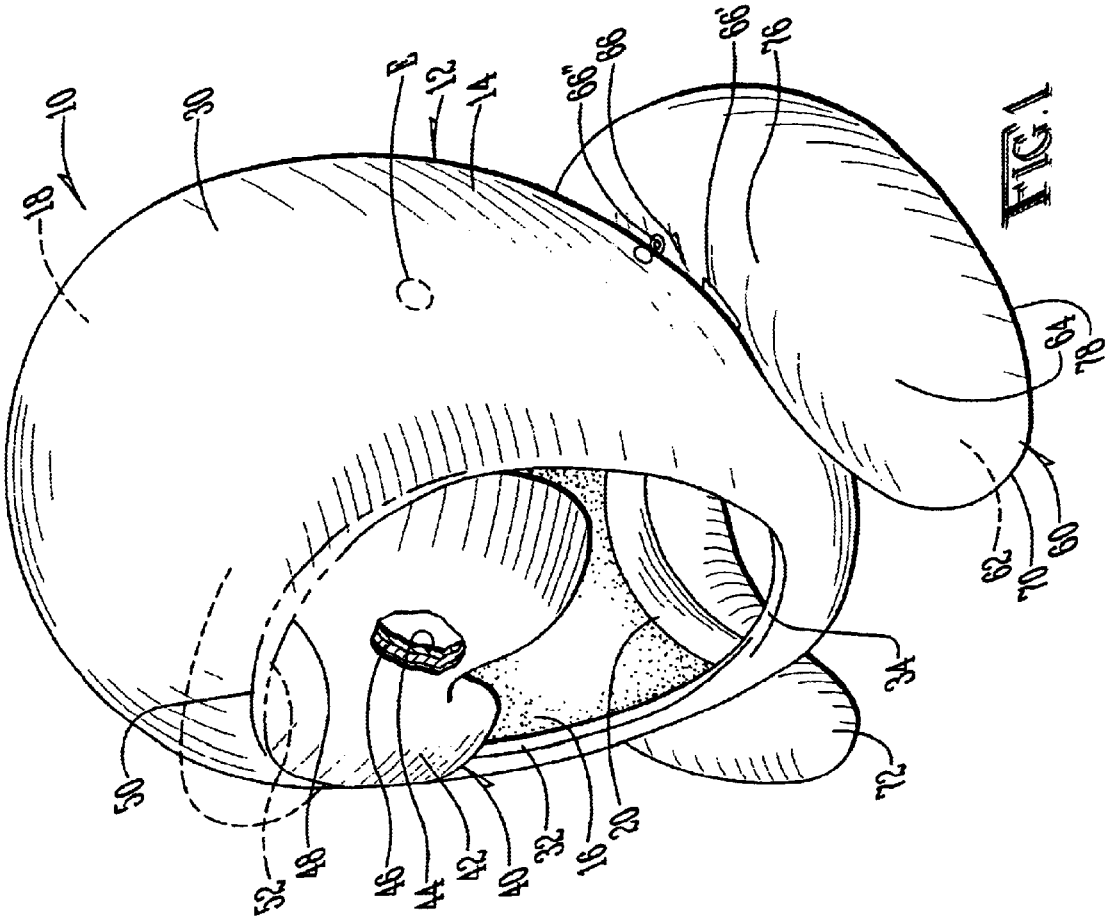
FIG. 1 is a perspective view of a first form of a wearable pillow embodying the present invention.

Referring to FIG. 1, it can be seen that the present invention is embodied in a wearable pillow 10 which comprises a head-covering portion 12 which includes an outer layer 14 which includes plastic-like material that is waterproof or the like. The head-covering portion 12 further includes an inner layer 16 which includes cotton-like material and an intermediate layer 18 located between the inner layer 16 and the outer layer 14 and which includes foam material. The inner layer 16 can be thicker at those locations which will be adjacent to the wearer's ears when the head-covering portion 12 is worn to block the ears and thus greatly reduce and perhaps entirely block noise from entering the wearer's ears. A special ear plug, such as indicated at E, can also be located to be adjacent to each of the wearer's ears when the head-covering portion 12 is worn. The ear-blocking portions can be formed of the same material as the inner layer 16 or can be formed of special ear-plugging material. At any rate, once the head-covering portion 12 is worn, the user's hearing will be impaired by pillow 10. One form of the pillow 10 includes layers that can be washed.

Pillow 10 further includes a stretchable neck-encircling portion 20 which entirely surrounds a neck of a user when head-covering portion 12 is worn by the user. The neck-encircling portion 20 serves to support the user's head and neck during use of pillow 10 as well as preventing drafts or the like from reaching the user's head and/or neck.

A one-piece head section 30 extends completely around and over the wearer's head from the neck-encircling portion 20 when the head-covering portion 12 is worn by the user. This prevents drafts and keeps the wearer warm while supporting the wearer's head. The head covering portion 12 is thick enough to act like a pillow even if the wearer is lying on his or her side.

A face-opening section 32 is defined in the head-covering portion 12 and positioned in front of a face of the user when the head-covering portion 12 is worn by the user. The face-opening 32 extends from a chin area of the face of the user to above an eyebrow section of the face of the user and from adjacent to one eye of the user to adjacent to another eye of the user when the head-covering portion 12 is worn by the user as can be envisioned by one skilled in the art from the teaching of the present disclosure. A perimeter 34 on the head-covering portion 12 surrounds the face-opening section 32 so a wearer can have his or her face comfortably exposed while wearing the pillow 10 of the present invention. Elastic or the like can be located in the perimeter 34 so the pillow 10 is snugly held against the face of the wearer. This not only prevents drafts, it also closes sneak paths for noise around the ear-covering portions of the pillow 10.

An eye-covering portion 40 is hingeably attached to the head-covering portion 12 to move between a first position covering an area of the face-opening 32 adjacent to at least one eye of the user and a second position spaced apart from the first position. The eye-covering portion 40 is shown in FIG. 1 in the first position and the second position is indicated in the partial dotted line showing in FIG. 1. The eye-covering portion 40 includes an outer layer 42, an inner layer 44 of cotton-like material, and an intermediate layer 46 of foam-like material. The eye-covering portion 40 is opaque to prevent light from reaching the wearer's eyes when the pillow 10 is worn with the eye-covering portion 40 in the first position.

A hinge 48 connects the eye-covering portion 40 to the head-covering portion 12 adjacent to a section 50 of the perimeter 34 surrounding the face-opening section 32. Hinge 48 can be a living hinge or it can be a jointed hinge as necessary and desired. Furthermore, the eye-covering portion 40 can be removably attached to the head-covering portion 12 by means of hook-and-loop fasteners, snaps or the like as indicated in FIG. 1 by releasable fastener 52. The eye-covering portion 40 can be removed from the head-covering portion 12 if desired.

Pillow 10 further includes neck-covering portion 60 which supports a wearer's neck and prevents drafts and noise from entering the head-covering portion 12 via neck-encircling portion 20. Neck-covering portion 60 includes an inside layer 62 of cotton, and an outer layer 64 of plastic-like material. A fastening element 66 is positioned on the head-covering portion 12 adjacent to the neck-encircling portion 20 of the head-covering portion 12 and on the neck-covering portion 60. The fastening element 66 can be hook-and-loop type material, such as indicated at 66' or it can be snaps or the like as indicated at 66". Other forms of fastening elements can be used without departing from the scope of the present invention as will occur to those skilled in the art based on the teaching of the present disclosure. Such additional forms of fastening elements are intended to be covered by the present disclosure as well.

The neck-covering portion 60 is releasably attached to the head-covering portion 12 when worn by the user, and further includes a first end 70 located adjacent to the chin area of the user when the neck-covering portion 60 is worn and a second end 72 which is also located adjacent to the chin area of the user when the neck-covering portion 60 is worn. The first end 70 of the neck-covering portion 60 is spaced apart from the second end 72 of the neck-covering portion 60 when the neck-covering portion 60 is worn.

A top section 76 of the neck portion 60 is located adjacent to the neck-encircling section 20 of the head covering portion 12 when the neck-covering portion 60 is worn and a bottom section 78 is located adjacent to a shoulder area of the user when the neck-covering portion 60 is worn.

Use of the pillow 10 of the present invention is evident from the above disclosure and thus will only be briefly discussed. A user forces his or her head upward through the neck-encircling portion 20 which is stretched to accommodate such a step inside the head-covering portion 12 with the user's ears located adjacent to any ear-covering portion of the pillow 10 and his or her face located in the face-opening area. The eye-covering portion 40 can be moved over the user's eyes if desired and the neck-covering portion 60 can be attached to the head-covering portion 12 if desired. In this manner, the wearer has his or her hearing and/or his or her sight blocked so he or she can obtain a restful sleep that is undisturbed by noise or light. The pillow 10 is removed by simply pulling it back off the user's head with the user's head moving through the stretchable neck-encircling portion 20.

Figure 2:
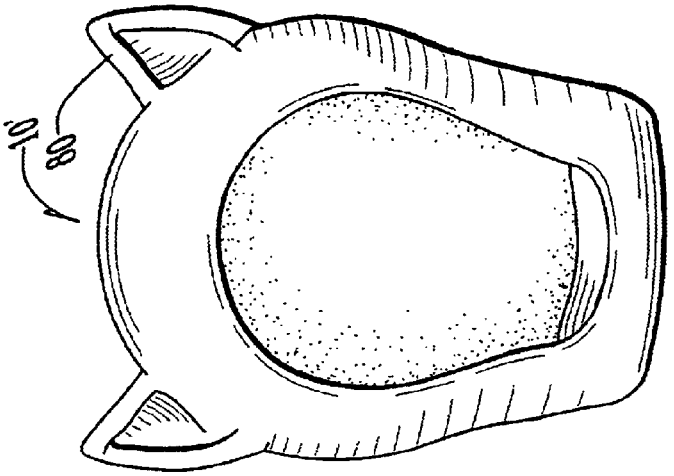
FIG. 2 is a front perspective view of a second form of a wearable pillow embodying the present invention.

An alternative form of the pillow is shown in FIG. 2 as pillow 10'. Pillow 10' is identical to pillow 10 with the exception of decorative elements, such as ears 80, or the like that are either permanently or detachably mounted on the head-covering portion 12. Pillow 10' is primarily intended for use by children. Other decorative elements can be used without departing from the scope of the present invention.

It is understood that while certain forms of the present invention have been illustrated and described herein, it is not to be limited to the specific forms or arrangements of parts described and shown.

What is claimed is:

1. A pillow comprising:

a) a head-covering portion which includes
(1) an outer layer,
(2) an inner layer,
(3) an intermediate layer which includes foam material,
(4) a stretchable neck-encircling portion which entirely surrounds a neck of a user when said head-covering portion is worn by the user,
(5) a one-piece head section which extends completely around and over a wearer's head from the neck-encircling portion when said head-covering portion is worn by the user,
(6) a face-opening section defined in the head-covering portion and positioned in front of a face of the user when said head-covering portion is worn by the user and which extends from a chin area of the face of the user to above an eyebrow section of the face of the user and from adjacent to one eye of the user to adjacent to another eye of the user when said head-covering portion is worn by the user, and
(7) a perimeter on said head-covering portion surround the face-opening section;

b) an eye-covering portion hingeably attached to said head-covering portion to move between a first position covering an area of the face-opening adjacent to at least one eye of the user and a second position spaced apart from the first position, said eye-covering portion including
(1) an outer layer,
(2) an inner layer,
(3) an intermediate layer of foam material,
(4) said eye-covering portion being opaque, and
(5) a hinge connecting said eye-covering portion to said head-covering portion adjacent to a section of the perimeter surrounding the face-opening section;

c) an ear-plugging portion located on the inside surface of said head-covering portion adjacent to an ear of the wearer when said head-covering portion is worn; and d) a neck-covering portion which includes
(1) an inner layer of material,
(2) an outer layer of material,
(3) a fastening element on said head-covering portion adjacent to the neck-encircling section of said head-covering portion and on said neck-covering portion,
(4) said neck-covering portion being releasably attached to said head-covering portion when worn by the user, and
(5) said neck-covering portion further including
(A) a first end located adjacent to the chin area of the user when the neck-covering portion is worn,
(B) a second end located adjacent to the chin area of the user when the neck-covering portion is worn,
(C) the first end of said neck-covering portion being spaced apart from the second end of said neck-covering portion when the neck-covering portion is worn,
(D) a top section located adjacent to the neck-encircling section of said head-covering when the neck-covering portion is worn, and
(E) a bottom section located adjacent to a shoulder area of the user when the neck-covering portion is worn.

2. The pillow as described in claim 1 further including an ornament element on the outer layer of said head-covering portion.

3. The pillow as described in claim 1 wherein the fastening element on said head-covering portion includes hook-and-loop elements.

4. The pillow described in claim 1 wherein fastening element on said head-covering portion includes snap elements.

5. The pillow as described in claim 1 further including a releasable fastener element connecting said eye-covering section to said head-covering section.

6. The pillow described in claim 1 wherein the outer layer of said head-covering portion is washable.

7. A wearable pillow comprising:

a) a head-encircling portion having an outer layer and an inner layer, with the inner layer including a portion thereof that covers the wearer's ears in a manner that reduces the amount of noise reaching the user's ears;

b) a stretchable neck-encircling section which completely encircles a user's neck when said head-encircling portion is worn by the user;

c) a face-exposing section defined in said head-encircling portion;

d) an eye-covering portion hingeably attached to said head-encircling portion adjacent to said face-exposing portion and movable between a first position covering the user's eyes and a second position uncovering the user's eyes when said head-encircling portion is worn by the user; and e) a neck-supporting portion releasably attached to said head-encircling portion when said neck-supporting portion is worn, said neck-supporting portion including
(1) a fastener which engages a fastener on said head-encircling portion when said neck-supporting portion is worn,
(2) an outer layer,
(3) an inner layer of cotton material, and
(4) two spaced apart ends.

* * * * *